United States Patent [19]

Kasprzyk

[11] Patent Number: 4,564,110

[45] Date of Patent: Jan. 14, 1986

[54] APPARATUS FOR POSITIONING GRAVITY FED COMPONENTS IN AN ELECTRICAL TEST FACILITY

[75] Inventor: Marlon Z. Kasprzyk, Westchester, Ill.

[73] Assignee: AT&T Technologies, Inc., Berkeley Heights, N.J.

[21] Appl. No.: 623,064

[22] Filed: Jun. 22, 1984

[51] Int. Cl.[4] ..... B07C 5/02; B07C 5/344

[52] U.S. Cl. ..... 209/544; 193/40; 193/44; 209/574; 209/655; 324/60 CD; 324/158 F

[58] Field of Search ..... 209/539, 540, 542, 544, 209/545, 571, 573, 574, 655, 924; 193/40, 44; 198/398, 399; 324/60 R, 60 C, 60 CD

[56] References Cited

U.S. PATENT DOCUMENTS

| | | | |
|---|---|---|---|
| 1,663,539 | 3/1928 | Bellinger | 209/655 X |
| 1,768,449 | 6/1930 | Heiny | 324/60 C |
| 2,468,843 | 5/1949 | Sunstein | 209/574 |
| 2,591,047 | 4/1952 | Burge et al. | 209/556 |
| 3,024,906 | 3/1962 | Jaensch | 209/564 |
| 3,701,021 | 10/1972 | Isaac et al. | 324/158 F |
| 3,761,806 | 9/1973 | Napor et al. | 324/60 C |
| 3,986,604 | 10/1976 | Siryj . | |
| 4,308,943 | 1/1982 | Gierhart | 193/44 X |
| 4,429,271 | 1/1984 | Doubek et al. | 324/60 CD |

FOREIGN PATENT DOCUMENTS

| | | | |
|---|---|---|---|
| 55-27955 | 2/1980 | Japan | 209/573 |
| 0738688 | 6/1980 | U.S.S.R. | 209/657 |

*Primary Examiner*—Robert B. Reeves
*Assistant Examiner*—Edward M. Wacyra
*Attorney, Agent, or Firm*—R. P. Miller; M. de Picciotto

[57] ABSTRACT

Capacitor blanks (10) are gravity advanced down an inclined chute (22) into engagement with a flipper vane (36) whereat one (18) of a pair of oppositely disposed test probes (18) and (19) is advanced to engage and push the capacitor blank into engagement with the other probe. If the capacitor blank is not engaged by the test probes so that a predetermined minimum capacitance reading is attained by a test set (29), the test probe (18) is withdrawn and a signal generated to control the operation of the flipper vane (36) which functions to thrust the capacitor back up the chute. Upon proper positioning of the capacitor and completion of a test, the flipper vane is again operated in such a fashion that the tested capacitor passes to a sorting device (61, 64, and 65) which directs the capacitor blank into either an accept recepticle (62) or reject recepticle (63).

13 Claims, 11 Drawing Figures

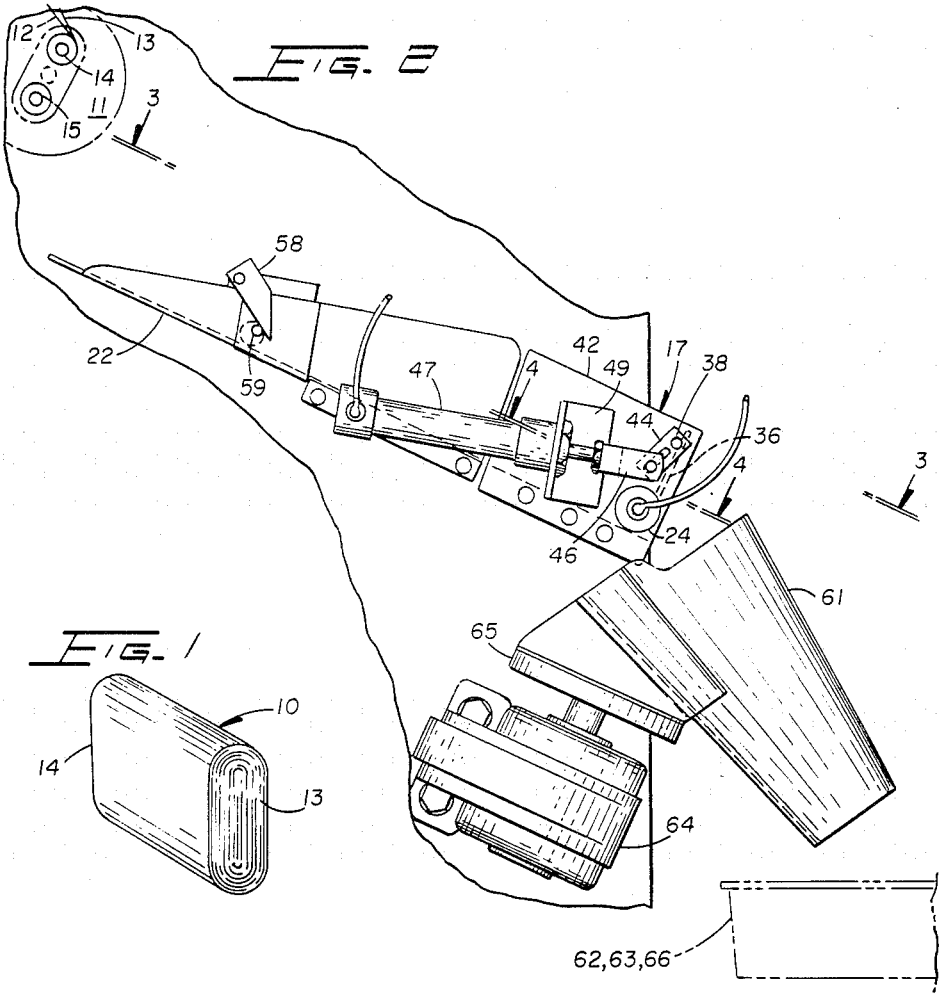
FIG. 2
12
13
14
11
15
3
58
22
59
47
4
42
49
17
38
44
36
4
3
24
46
61
65
64
62,63,66
FIG. 1
10
14
13
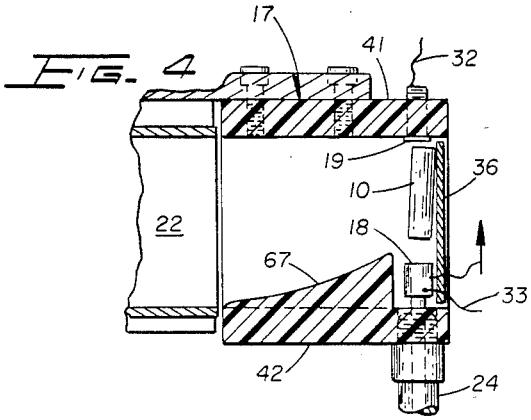
FIG. 4
17
41
32
19
36
10
22
18
67
33
42
24

APPARATUS FOR POSITIONING GRAVITY FED COMPONENTS IN AN ELECTRICAL TEST FACILITY

FIELD OF INVENTION

This invention relates to apparatus for positioning randomly fed and oriented components in an electrical test facility, and more particularly to apparatus for orientating capacitor blanks that are gravity advanced down a chute with respect to a pair of test probes, together with instrumentalities for thrusting improperly positioned capacitor blanks up the chute to permit subsequent gravity feed into a proper orientation.

BACKGROUND OF THE INVENTION

During the course of manufacture of many diverse types of electrical devices, it is necessary to conduct successive tests following each of a number of fabricating steps in order to preclude subsequent processing of defective product. For example, in the manufacture of an electrical device, such as a rolled metallized film capacitor, tests are conducted following the rolling or winding of the metallized film into a capacitor blank so that defective products are removed from the manufacturing process prior to forming heat fusible electrodes on the ends of the rolled capacitor blank. Further, following each test, it is desirable to sort and feed the capacitor blanks into designated ones of a group of recepticles. During the feeding of the film capacitor blanks, care must be exercised that the capacitor blank is not damaged. In order to avoid such damage, the feed facilities should be designed so that positively driven mechanically feed elements do not engage and mar the capacitor blanks.

Many apparatuses have been developed for sequentially testing a train of advancing electrical devices. One such apparatus is shown in U.S. Pat. No. 2,468,843 issued May 3, 1949 to D. E. Sunstein wherein resistors arrayed in a stack are successively pushed between and held by a pair of spring loaded test contacts. Upon completion of an electrical resistance test of each resistor, a solenoid control ejector is operated to force the tested resistor into a chute in which are selectively positioned interrupt doors that intercept the falling resistors to direct each resistor into a box in accordance with resistance limits determined by the electrical resistance test. There is still a need for an apparatus which will accept randomly oriented articles, and then feed, position, test and accordingly sort the articles in accordance with test characteristics with a minimum amount of physical contact.

SUMMARY OF INVENTION

This invention comtemplates, among other things, a gravity feed and orienting chute for advancing each of a succession of randomly positioned components into oriented positions with respect to a pair of electrical test probes wherein the presence of an improperly oriented component is detected causing the generation of a signal that operates a kicker device to thrust the component back up the chute for another attempt at a downward movement into the desired oriented position.

More particularly, capacitor blanks are dropped from a winding machine onto an incline chute in random fashion so that the capacitor blanks move past a sensing device and into a position against a kicker gate and between a pair of electrical test probes. An arcuate plate is mounted within the chute in the path of the moving capacitor blank to guide the blank into the desired position. After sensing the passage of the blank down the chute, a programmed controller is initiated into a cycle of operation. The controller, after a delay, generates signals that are utilized to move one of the test probes to engage the properly oriented capacitor blank so as to trap the blank between the test probes. Test signals applied to the probes are analyzed to produce output signals that are utilized to control the setting of a sorting chute. Upon completion of the test, the controller sends a signal that is effective to open the gate and pass the tested capacitor blank into the sorting chute where the blank is routed to one of a group of receiving recepticles.

If the capacitor blank resting against the kicker gate is not properly oriented with respect to the test probes, the movement of the test probe will strike and move the capacitor blank, but the capacitor will not be trapped between the test probes. In this instance, the test facilities will not detect a capacitance whereupon the controller generates a further signal to withdraw the probe thereby allowing the struck capacitor blank to again drop and, perhaps, move into the desired oriented position. The test probe is again advanced and if the capacitor is now trapped between the test probes, a test is conducted.

If, upon the second advance of the test probe, no properly oriented capacitor blank is engaged and trapped between the probes, the test probe is withdrawn and the controller generates a further signal that is effective to partially operate the kicker gate. The kicker gate is not opened to a degree such that the capacitor can pass to the sorting chute. The kicker gate is rapidly returned to the initial position to thrust the capacitor back up the gravity chute to allow the blank to again drop and move into the desired oriented position between the test probes.

BRIEF DESCRIPTION OF THE DRAWINGS

Other advantages and features of the invention will be apparent from the following description when considered in conjunction with the drawing wherein:

FIG. 1 is a perspective view of a roll metallized film capacitor blank;

FIG. 2 is a side view of an apparatus for gravity feeding, orienting, testing, and sorting capacitor blanks or other electrical devices, embodying the principles of the present invention;

FIG. 4 is a partial sectional view taken along line 4—4 of FIG. 2 showing a properly oriented capacitor blank located between a pair of electrical test probes and resting against a kicker gate;

DETAILED DESCRIPTION

Figure 3:
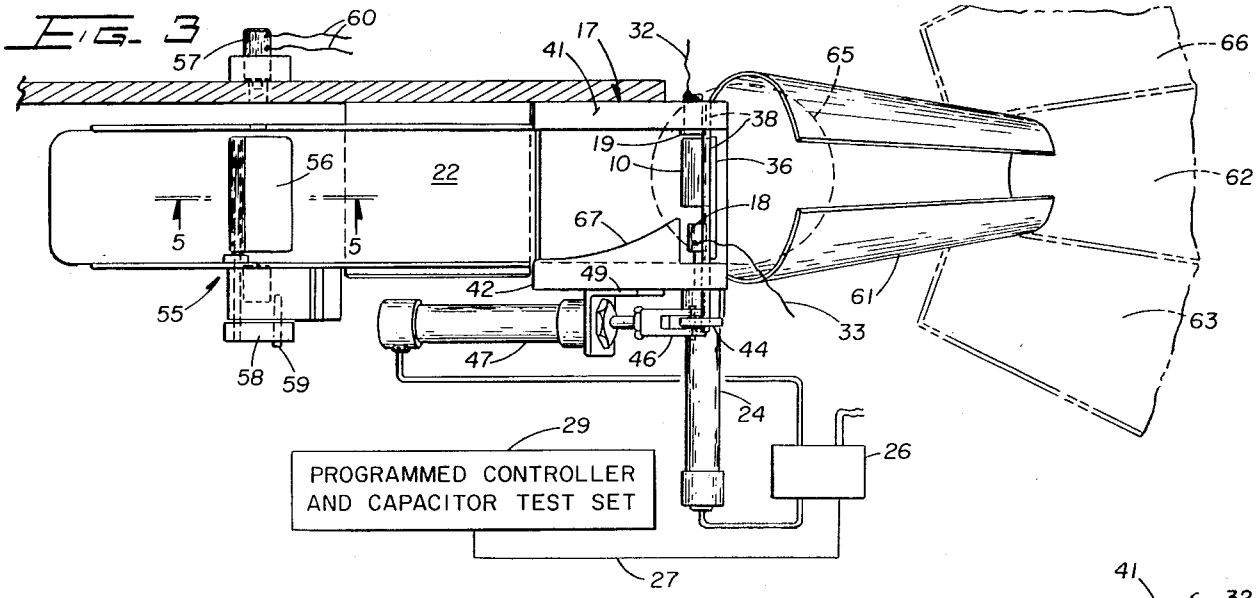
FIG. 3 is a top view of the apparatus shown in FIG. 2 illustrating the construction of a gravity chute together with a schematic showing of a programmed controller.

FIG. 1 of the drawing discloses a metallized film wound capacitor blank 10 of particular concern herein to be gravity fed to a test station, properly nested thereat and then reliably electrically contacted for testing. When the capacitor blank is initially fabricated in a winding device 11 schematically shown in FIG. 2, a pair of films 12 and 13, each metallized on one surface, are wound in offset relation on a pair of retractable winding mandrel pins or arbors 14 and 15 in such a fashion that the metallized edge surface of a first of the films projects from the other wound film while the metallized edge surface of the other film projects from the first wound film. The exposed metallized edges of such a wound film capacitor blank form opposite end electrodes 16 and 17 thereof. The metallized edges of the wound film are normally coated with a thin layer of solder in a subsequent processing operation so as to form solder block type end electrodes (not shown).

While the capacitor blank 10 is shown as being of oval cross-section, in FIGS. 1 and 2, it is understood, of course, that it could also be formed with any other desired tubular or flat configuration. When such capacitor blanks are of non-cylindrical cross-section, however, the problem of attaining the required nested orientation for testing is compounded. Though the invention is described with respect to the orienting and testing of capacitor blanks, it is to be understood that the principles of the invention can be used to orient and test other types of components such as resistors, solid state components, inductors, etc. Further the orienting facilities may find widespread adaptability in processing a great variety of other products.

FIGS. 3–11 disclose an apparatus 17 which is adapted to facilitate the gravity feeding seriatim, positioning, testing and release of capacitor blanks 10 which for purposes of illustration are shown as being of a round tubular shape. The apparatus 17 includes a pair of laterally spaced test probes 18 and 19 which are initially spaced a sufficient distance apart so as to readily accommodate a number of different codes of capacitor blanks 10. The latter are successively gravity fed down an inclined feed chute 22 and hopefully initially acquire a necessary axially oriented nested position between the test probes, as best seen in FIGS. 3 and 4.

As seen in FIG. 3, the test probe 18 is mounted for reciprocal displacement under the control of a pneumatic cylinder 24. The latter is actuated through a solenoid-controlled valve 26 which, in turn, is operated via a lead 27 by a test set 29, such as disclosed in U.S. Pat. No. 4,429,271 issued to E. B. Doubek and M. Z. Kasprzyk on Jan. 31, 1984 which preferably operates in conjunction with a programmed controller or microprocessor, such as INTEL'S SBC 80/24, manufactured by Intel Corp., Santa Clara, Calif. The test probes 18 and 19 are connected through leads 32 and 33, respectively, to the test set 29.

In order to facilitate the proper orientation of each capacitor blank 10 between the test probes 18 and 19, not only the test probe 18 is reciprocally operated in a programmed manner, but a pivotal "kick-back" or flipper gate or vane 36, located at the downstream end of the feed chute 22, is also programmed to operate in a sequential manner with the displacement of the test probe 18.

As illustrated in FIGS. 2 and 3, the pivotal vane 36 is supported at its upper end by a shaft 38 that extends between two sidewalls 41 and 42 of the feed chute 22, with one end of the shaft extending through the sidewall 42 and being fixedly secured to a short lever 44. The latter is pivotally pin coupled in an arcuate slot formed in a clevis 46 which, in turn, is secured to the outer end of the piston of a pneumatic cylinder 47. The pneumatic cylinder is supported by an L-shaped bracket 49 which is suitably secured to the feed chute sidewall 42.

The composite apparatus 17 also includes a capacitor sensing assembly 55 (see FIG. 3) which is located near the upstream end of the feed chute 22. The sensing assembly comprises a pivotally mounted L-shaped second gate or vane 56 (best seen in FIG. 5) and a photodetector 57 that is partially mounted below the lowermost leg of the vane 56. Attached to a shaft for mounting the vane is a lever 58 which engages a pin 59 extending from a sidewall of the chute to limit downward movement of the lever. The weight of the lever acts to hold the vane in an initial position spaced from the floor of the chute. The light weight of the lever and the pivotally mounted gate permits the gravity fed capacitor to readily pass under the vane 56. The photodetector 57 senses each capacitor blank 10 when gravity fed thereby, and generates a control signal that is sent to the test set via leads 60 to initiate, after a delay sufficient for the capacitor to move into engagement with the vane 36, the start of each successive test period.

The pivotal vane 56 serves two functions. First, it effectively shields the photodetector 57 from detrimental ambient light which could otherwise cause a false capacitor blank-sensed signal to be sent to the test set 29. Secondly, the pivotal vane 56 also prevents any capacitor blank 10 that has been gravity fed past the photodetector 57 to be subsequently "kicked-back" or thrust up the feed chute 22 to a position where it could again be sensed by the photodetector and, thereby, cause a false test period start signal to be sent to the test set for the same capacitor blank.

Consideration will now be given to several possible operating conditions that could occur in utilizing the apparatus 17 for testing a succession of components, such as the leadless capacitor blanks 10. Initially, each capacitor blank, after having been released from the arbor 14–15 of a winding machine 11, is directed to, and gravity fed downwardly along, the inclined feed chute 22 until stopped by the pivotal "kick-back" vane 36. Hopefully, at that time, the capacitor blank is nested against the pivotal vane 36 in an axially oriented position relative to, and between, the spaced test probes 18 and 19, as indicated in FIGS. 3 and 4. When that is the case, the movable test probe 18 is projected outwardly sufficiently to cause the two probes 18 and 19 to contact different ones of the capacitor blank electrodes 13 and 14.

Upon the test set 29 then sensing a predetermined minimum value of capacitance exhibited by the capacitor blank at that time (assuming the latter is not totally defective), the actual value of capacitance is then measured and suitably recorded and/or displayed. The pneumatic cylinder 24 is then actuated to retract the test probe 18 to its "home" position. Immediately thereafter the pneumatic cylinder 47 is actuated to effect the outward pivoting of the pivotal vane 36 so as to release the capacitor blank for routing through a settable chute into either a satisfactory storage bin 62 or unsatisfactory storage bin 63. Should a given capacitor blank 10 not register a minimum predetermined value of capacitance, but some value thereof greater than zero capacitance, such a capacitor would be immediately released by the pivotal vane 36 and routed through chute 61 and directed to the unsatisfactory storage bin 63. The position of the chute 61 is controlled by a stepping motor 64 which selectively rotates a platform 65 on which the chute 61 is mounted in accordance with the results ascertained by the test set.

In a typical high volume testing operation, it is appreciated that a given capacitor blank 10 may often acquire a skewed orientation in descending along the feed chute 22 and, as a result, possibly come to rest against the pivotal vane 36 in any one of a number of different undesirable positions. When that happens, it becomes readily apparent that the test probes 18 and 19 cannot electrically engage different ones of the end electrodes 13 and 14 of the capacitor blank 10. Compounding the problem of axially aligning gravity fed capacitor blanks 10 between the test probes 18 and 19 is the fact that they are often fabricated with not only an oval cross-section, as depicted in FIG. 1 (as distinguished from a cylindrical cross-section as depicted in FIGS. 3–10), but also with an axial length dimension that is often not much larger than the width dimension thereof.

Figure 6:
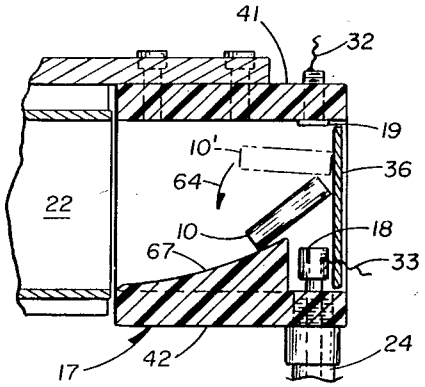
FIG. 6 is a cross-sectional view similar to FIG. 4 showing an improperly positioned capacitor blank resting against the kicker gate.
Figure 5:
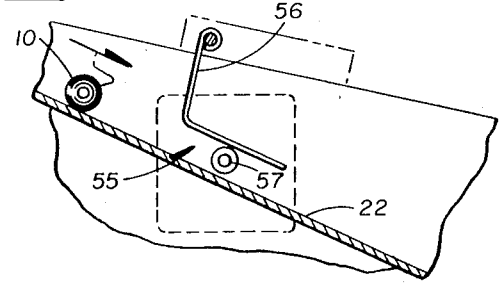
FIG. 5 is a sectional view taken along line 5—5 of FIG. 3 depicting a sensor for ascertaining the passage of a capacitor blank down the chute.

FIG. 6 is a fragmentary plan view illustrating an operating condition wherein one end of the capacitor blank 10 initially comes to rest against the pivotal vane 36 in a skewed manner, with the other end resting against an arcuate ramp 67 which is secured to the feed chute sidewall 42. The ramp 67 is employed to facilitate the axial positioning of each capacitor blank 10 between the test probes 18 and 19 and, in practice, tends to minimize the possibility of a capacitor blank 10 attaining a skewed position as illustrated in FIG. 6.

However, when a given capacitor 10 does acquire such a skewed position, the sequence of operations to effect a capacitance test is programmed as follows: The displaceable probe 18 is initially projected rapidly toward and contacts the underside of the angularly positioned capacitor blank 10, in an undercutting manner. This operation alone would most often result in the capacitor blank acquiring the desired axially oriented position depicted in FIG. 4. As a minimum capacitance reading could not be obtained during this first outward projection of the displaceable test probe 18 (since no probe-capacitor electrode contact had been established, at least at both ends of the capacitor blank), the test probe 18 is programmed to rapidly retract to a "home" position, and is then immediately projected outwardly a second time. This causes the opposite electrode end of the then hopefully properly nested capacitor blank 10 to be pushed against the stationary test probe 19. With reliable test probe-capacitor blank electrode contact then being established, a value of capacitance above the minimum predetermined value is immediately sensed by the test set 29. Thereafter, the actual value of capacitance is then measured and suitably displayed and/or recorded. Immediately thereafter, a control signal from the test set 29 effects the actuation of the pneumatic cylinder 47 which, in turn, causes the pivotal vane 36 to pivot in a direction to release the tested capacitor blank 10 to be routed through the selectably positioned chute 61 into the appropriate storage bin. It is readily perceived that a great many receiving storage bins may be provided and the sorting chute may be positioned to route the capacitors in the appropriate bins in accordance with capacitance values ascertained by the test set.

FIG. 6 shows another possible test station landing position for a capacitor blank 10 to be tested. In this case, the capacitor blank shown in phantom and designated 10' initially comes to rest against the pivotal vane 36 in a vertical position relative thereto, and located along an intermediate region between the test probes 18 and 19. Upon the test probe 18 being initially projected outwardly at the start of a new sequence of operations to effect a capacitor test, it would normally contact a lower region of the capacitor blank 10', causing it to "tip over" in the direction of the arrow 64 so as to again acquire the desired nested orientation depicted in FIGS. 3 and 4. Thereafter the test sequence would be the same as previously described.

Figure 7:
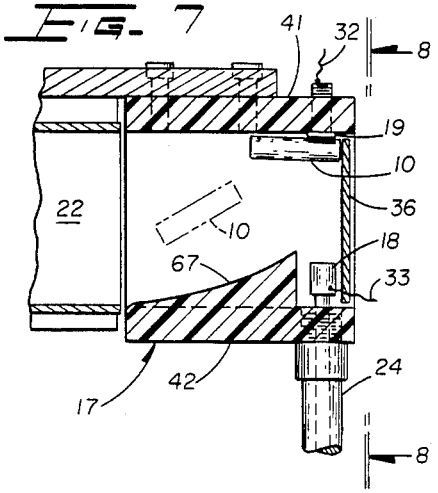
FIG. 7 is a view similar to FIG. 6 showing another improperly oriented capacitor blank.
Figure 8:
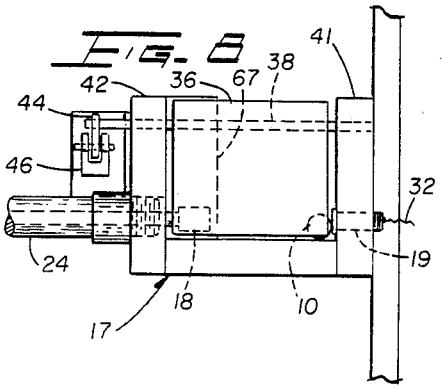
FIG. 8 is a front view looking in the direction of the arrows 8—8 in FIG. 7 again showing the misoriented capacitor blank resting against the kicker gate.

FIGS. 7 and 8 illustrate another possible operating condition. More specifically, should a vertically oriented capacitor blank 10 initially be positioned much closer to the stationary test probe 19 than to the test probe 18, or actually rest up against the test probe 19, as illustrated, the test probe 18 could then not contact the capacitor blank when initially projected outwardly at the start of a given test period. The test probe 18 would then immediately retract and be projected outwardly a second time under the programmed control of the test set 29. Upon the test set 29 having failed to sense a minimum value of capacitance between the test probes during this portion of the test period, a control signal from the test set effects the programmed actuation of the pneumatic cylinder 47. This causes the pivotal vane 36 to initially pivot rapidly a short angular distance in an opening direction, and then pivot back in a closing or "kick-back" direction. This bidirectional angular movement is effected so rapidly that the improperly oriented capacitor blank 10 cannot be released, but rather, is propelled part way up the inclined feed chute 22 and then returned by gravity feed to a position which, at least the second time in abutting against the pivotal vane 36, will almost always result in the capacitor blank being properly oriented between the test probes 18 and 19. This operation, if necessary, may be repeated any predetermined number of times (normally no more than three), until the capacitor blank either acquires the proper orientation for testing, as depicted in FIG$. 3 and 4, or is released by the pivotal vane 36, prior to being tested, into a segregated storage bin 66 for subsequent batch testing at a later time, for example.

Figure 9:
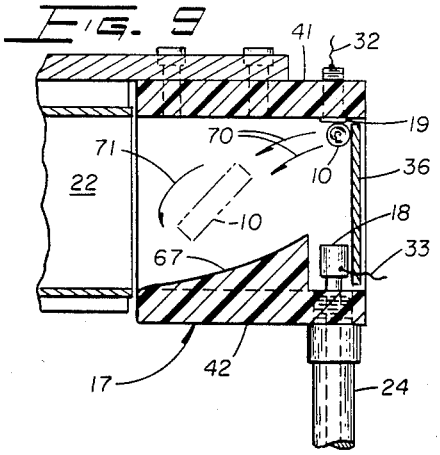
FIG. 9 is a view similar to FIGS. 4 and 6 showing another possible position of an improperly oriented capacitor blank.
Figure 10:
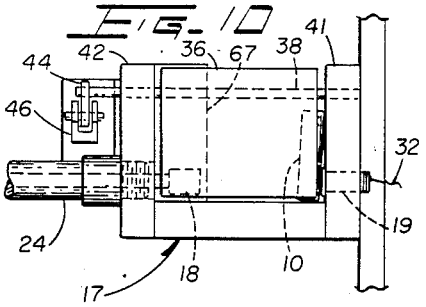
FIG. 10 is a front view similar to FIG. 8 showing the misoriented capacitor blank resting against the kicker gate.

FIGS. 9 and 10 illustrate still another possible test station landing position of a given capacitor blank 10. As illustrated, the capacitor blank has acquired an axial orientation that is parallel (as distinguished from perpendicular, as in FIGS. 7 and 8) to the pivotal vane 36, with one end portion thereof resting against the stationary test probe 19. In such a situation, the operations of the displaceable test probe 18 and the pivotal vane 36 are carried out in the same sequential manner as described above with respect to the condition depicted in FIGS. 7 and 8. Upon the capacitor blank being propelled part way up the feed chute 22, as indicated by the arrows 70, it will hopefully also be twisted, such as in the direction of the arrow 71, so as to ultimately be repositioned against the pivotal vane 36 with the proper orientation for testing.

When the "kick-back" vane thrusts the capacitor blank back up the chute, the blank may strike the L-shaped vane 56 which is now in a down position to preclude the passage thereunder. If the capacitor blank were permitted to pass under the vane 56, the photodetector 57 would be falsely operated to reinitiate another test cycle.

Figure 11:
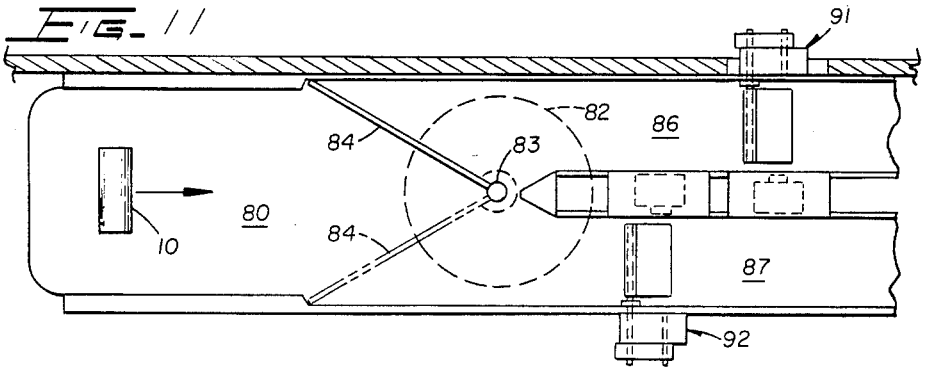
FIG. 11 is a top view of a further embodiment of the invention wherein a single chute is utilized in cooperation with a switch blade to alternating route capacitor blanks into a pair of orienting, testing, and sorting devices.

Referring to FIG. 11 there is shown a further embodiment of the invention which is adapted to handle the orientation and testing of capacitor blanks that are dropped onto a gravity chute 80 at a greater rate than the capacitors were dropped on the gravity chute 22 shown in the other view. In this instance upon completion of the winding of each capacitor blank by the winding machine 11, a signal is sent to the program controller which in turn generates a signal to operate a stepping motor 82 to rotate a shaft 83 on which is mounted a switch blade 84. The switch blade alternately moves between the solid line position and the dashed line position to alternately direct the capacitor blanks 10 into chute sections 86 and 87.

The chute sections 86 and 87 are associated with sensing devices 91 and 92 identical to sensing device 55. The chute sections 86 and 87 are provided with orienting and testing facilities that are identical with the orienting testing facilities described with respect to FIGS. 2–10.

What is claimed is:

1. An apparatus for orienting articles, which comprises:

a gravity chute for receiving an article;

a pivotally mounted gate located at the lower end of said chute for retaining an article advanced down said chute;

means for detecting an article retained by said gate in a predetermined orientation and for accordingly pivoting and opening said gate to pass the article under the opened gate; and means responsive to said detecting means failing to detect the article in the predetermined orientation for pivoting the gate in an upstream direction to kick the article back up said gravity chute.

2. An apparatus as defined in claim 1 which comprises:

means for sensing the passage of an article down said chute for conditioning said detecting means to operate after a time delay sufficient for the article to advance and be retained by said gate.

3. An appartus as defined in claim 1, which comprises:

a plate pivotally mounted to project into said chute at a position upstream of said gate and pivoted by an article moving down said chute for limiting movement of an article kicked upstream of said chute by operation of said pivoting gate to kick an article upstream of said chute.

4. An apparatus as defined in claim 3 wherein said plate is L-shaped with the vertical leg being pivotally mounted and said horizontal leg being directed downstream within said chute.

5. An apparatus as defined in claim 1 which comprises:

a second movably mounted chute mounted downstream of said pivoting gate for receiving an article passed by said pivoting gate;

means including said detector means for testing a charactertistic of said article; and means responsive to the detecting means ascertaining a properly orientated article and said testing means ascertaining a predetermined characteristic of the article for accordingly positioning said second chute.

6. An apparatus as defined in claim 5 wherein:

said article is a capacitor, and said testing means ascertains the capacitance of said capacitor.

7. An apparatus for testing an electrical device having a pair of oppositely disposed electrodes, which comprises:

a pair of test probes spaced apart a distance sufficient to receive an electrical device with the electrodes of a properly oriented device aligned with the test probes;

an inclined chute for guiding the electrical device to a position between the test probes;

a flipper member pivotally mounted and initially positioned with respect to said chute for retaining an electrical device at said position in said chute between said test probes;

means for moving one of said test probes toward the other into a position to engage the electrodes of a properly oriented electrical device between said test probes;

means connected to said test probes for determining an electrical characteristic of the electrical device; and means responsive to the test probes failing to engage the electrodes of an electrical device for reciprocating said movable one of said test probes and initiating a second operation of said test probes.

8. An apparatus as defined in claim 7, which comprises:

means responsive to said test means determining the electrical characteristic of said electrical device for pivoting said flipper member a sufficient amount in a first direction to permit passage of the electrical device to pass from the position between said test probes.

9. An apparatus as defined in claim 7, wherein said second operation includes:

means responsive to said test probes failing to engage the electrodes of an electrical device for pivoting said flipper means in a first direction by an amount insufficient to permit passage of said electrical device and then in a second direction to thrust said electrical device back up said chute.

10. An apparatus as defined in claim 7, which comprises:

a sensing means positioned along the path of travel of the electrical device down said chute for sensing the passage of the electrical device and for conditioning said test means to initiate a testing of the electrical device upon the electrical device arriving at the position between said test probes.

11. An apparatus as defined in claim 10, wherein said sensing means comprises:

a shield pivotally mounted with respect to said chute and under which said electrical devices passes and lifts as said electrical device moves along said chute;

said shield positioned to block an electrical device thrust back up said chute; and photoelectric means for detecting the electrical device passing under said shield.

12. An apparatus as defined in claim 7, which comprises:

a member having an arcuate surface extending into said chute for engaging and guiding an electrical device moving down said chute into a position between said test probes.

13. An apparatus for orienting, testing and sorting rolled metallized film capacitor blanks, which comprises:

an inclined gravity chute for receiving a capacitor blank;

a kicker gate pivotally mounted at the lower end of said gravity chute for retaining the capacitor blank advanced down said chute;

a pair of test probes mounted on opposite sides of said chute in the vicinity of said kicker gate and located to receive therebetween the capacitor blank retained by said kicker gate, at least one of said probes mounted for movement toward the other probe to engage the capacitor blank between said probes;

a second pivotable gate mounted upstream of said kicker gate and under which the capacitor blank moves while moving down said chute;

means for sensing a capacitor blank moving down said chute and under said second pivotable gate to generate a start signal;

testing means responsive to said moveable test probe engaging a capacitor blank between said test probes and said start signal for testing the capacitance of the capacitor blank;

a movable gravity chute positioned beyond said kicker gate;

means responsive to said testing means ascertaining the capacitance of the capacitor blank and accordingly moving said movable chute in one of a number of positions in accordance with the ascertained capacitance and for pivoting said kicker gate a sufficient amount to pass the tested capacitor blank to the movable chute; and means responsive to the failure of said moving test probe to engage a capacitor blank between said test probes for partially opening and then closing said kicker gate to thrust the capacitor blank back up the gravity chute and against said second pivotable gate to allow the capacitor blank to again move down said gravity chute in an attempt to move into a properly oriented position between said test probes.

* * * * *